US005456028A

United States Patent [19]

Larson

[11] Patent Number: 5,456,028

[45] Date of Patent: Oct. 10, 1995

[54] BACKHOE BUCKET RIPPER ATTACHMENT

[76] Inventor: David S. Larson, P. O. Box 1711, Cave Creek, Ariz. 85331

[21] Appl. No.: 110,251

[22] Filed: Aug. 23, 1993

[51] Int. Cl.[6] ..... E02F 3/76

[52] U.S. Cl. ..... 37/404; 37/403; 37/408; 37/410; 37/903; 172/699

[58] Field of Search ..... 37/232, 241, 903, 37/408, 410, 409, 404, 407, 403, 406, 468; 172/777, 784, 797, 772.5, 699

[56] References Cited

U.S. PATENT DOCUMENTS

| | | | |
|---|---|---|---|
| 2,969,966 | 1/1961 | Matheis | 37/404 X |
| 3,061,123 | 10/1962 | Rogers | 37/404 X |
| 3,702,712 | 11/1972 | Cairns | 37/404 X |
| 3,778,111 | 12/1973 | Ciofani | 37/404 X |
| 4,038,766 | 8/1977 | Felstet | 37/455 |
| 4,041,624 | 8/1977 | Fryrear | 37/404 |
| 5,115,583 | 5/1992 | Vail | 37/403 X |
| 5,197,212 | 3/1993 | Vail | 37/403 |

*Primary Examiner*—Randolph A. Reese
*Assistant Examiner*—Andrea Chop
*Attorney, Agent, or Firm*—Jordan M. Meschkow; Lowell W. Gresham

[57] ABSTRACT

In an excavating apparatus including a bucket removably coupled to a distal end of a hydraulically powered boom, a field-detachable and field-attachable ripper comprises a shank portion having a lower tip, a mounting portion disposed along an upper area of the shank portion and a detachable and re-attachable coupling element disposed along the mounting portion. The detachable and re-attachable coupling element secures the ripper to the bucket. There is optionally further included a detachable ripper tip coupled to the lower tip. The detachable ripper tip comprises a metal piece having a point disposed at a first end thereof and having a hollow disposed at a second end thereof. The hollow is adapted to accommodate the lower tip therein. The detachable ripper tip further includes an opening disposed on one side thereof and extending into the hollow. The opening is adapted to accommodate a fastener extending from the side and into the lower tip. The fastener thereby detachably fastens the detachable ripper tip to the lower tip.

12 Claims, 3 Drawing Sheets

FIG. 4
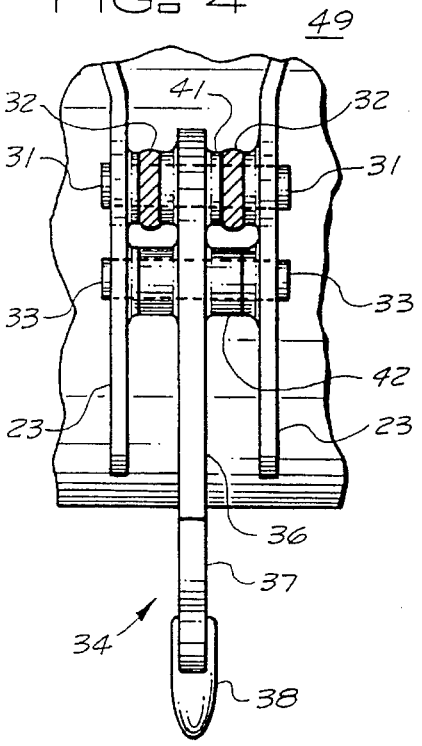
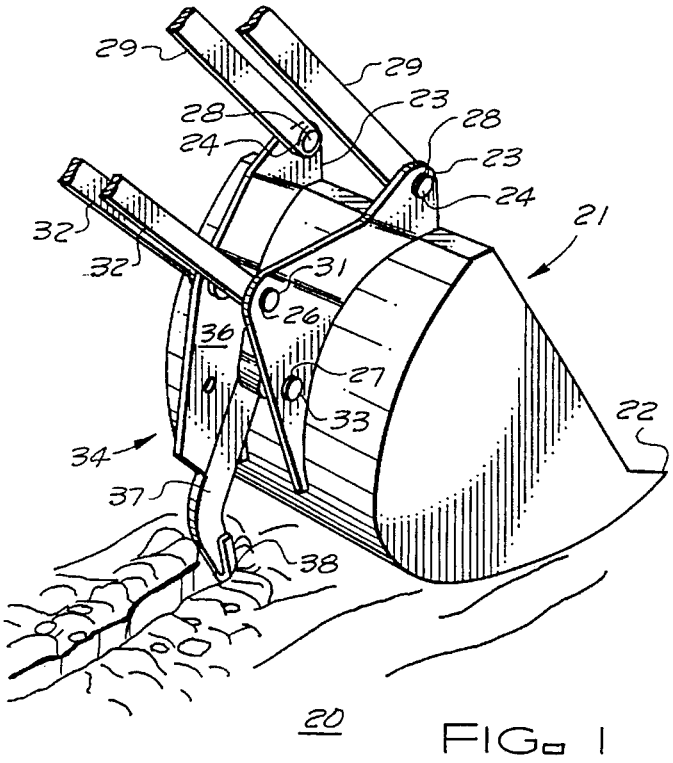
FIG. 1
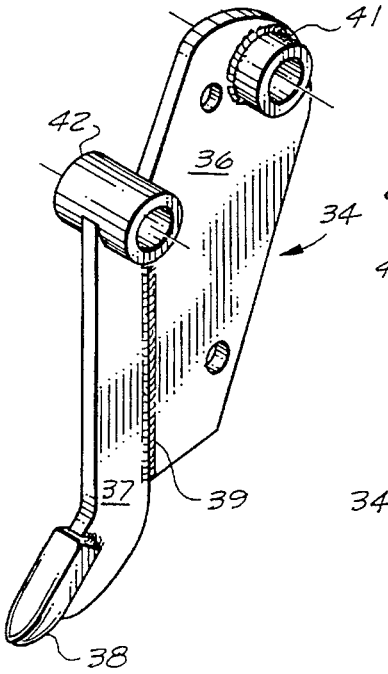
FIG. 3
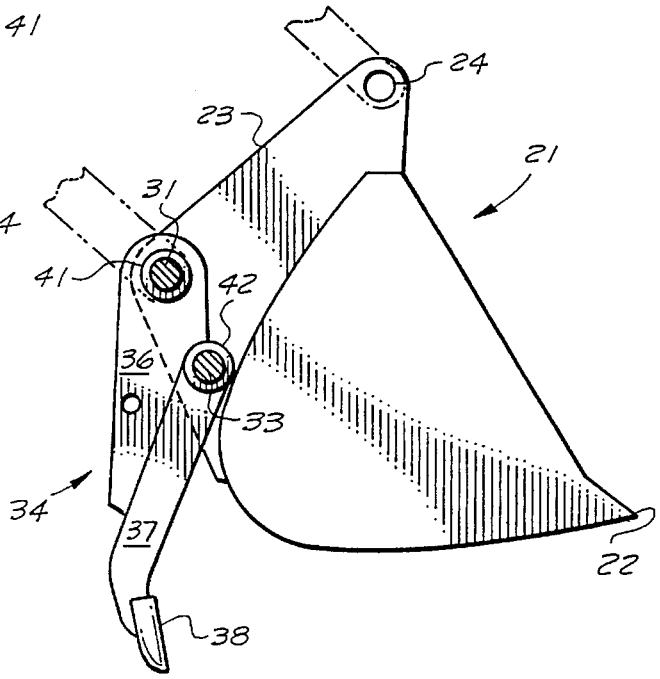
FIG. 2

FIG. 12
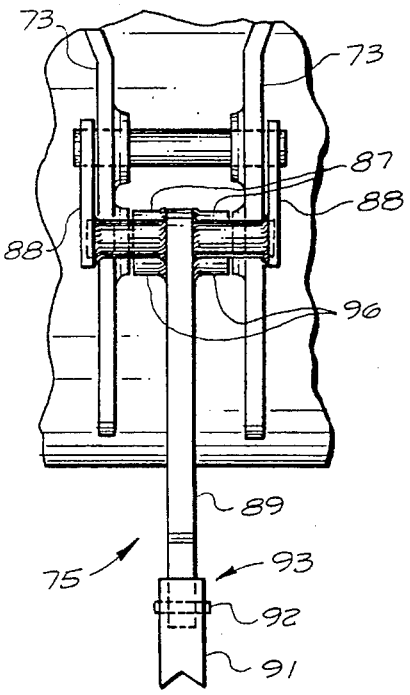
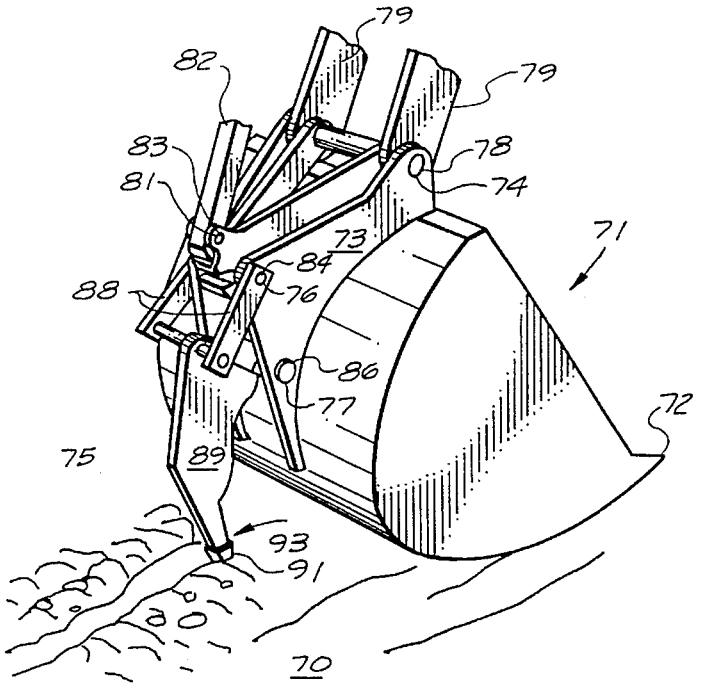
FIG. 9
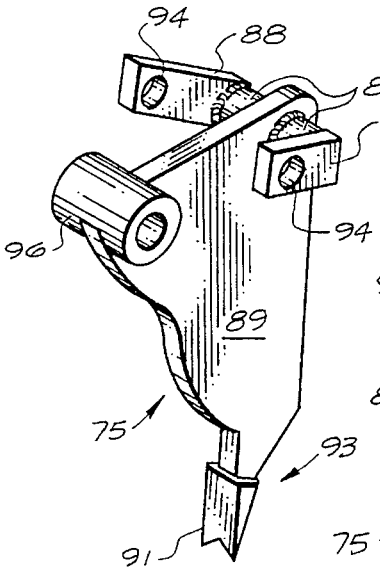
FIG. 11
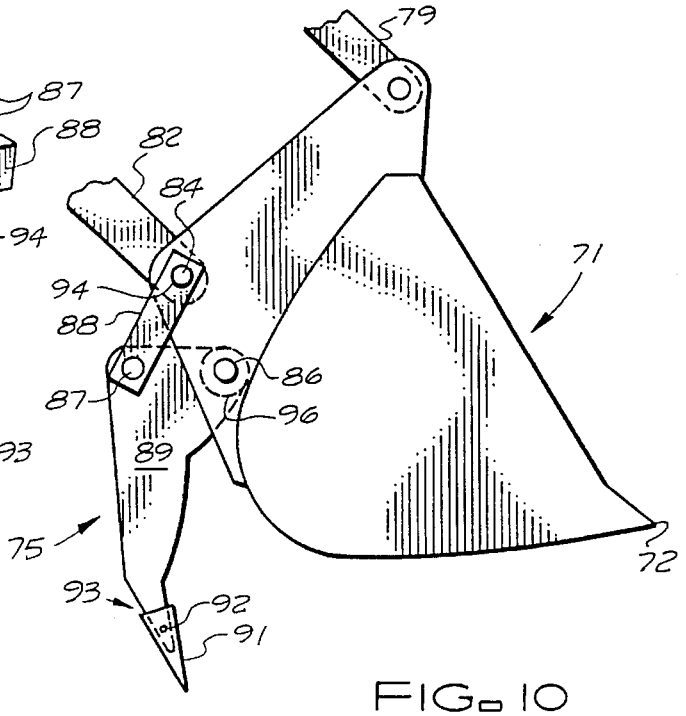
FIG. 10

BACKHOE BUCKET RIPPER ATTACHMENT

BACKGROUND OF THE INVENTION

1. Field of the Invention

This invention relates to attachments for buckets intended for application to backhoes and related excavating machinery.

More particularly, the present invention relates to rippers coupled to construction equipment buckets for breaking up materials being handled thereby.

In a further and more specific aspect, the instant invention concerns a method and apparatus for providing field-installable and detachable rippers for attachment to buckets of the type employed with backhoes and similar earth-moving equipment.

2. Prior Art

Attachments of great variety in construction and purpose are often employed with construction equipment such as backhoes and the like. For example, buckets of varying width and capacity are often employed in accordance with the amount of material to be removed and in conformance with the width and depth of opening desired. For example, a ditch for installation of plumbing need only be wide enough to accommodate the plumbing and the work involved in installation thereof. A relatively narrow bucket having a relatively small capacity is appropriate for this task, while a larger bucket is useful for excavation of larger areas such as basements, foundations and beds for roadways, for example.

Accordingly, it is often necessary to provide several bucket sizes at a single construction site, which site may be at some remove from a contractor's equipment storage and maintenance facilities. In many cases, this is most readily accomplished by providing excavation equipment with a plurality of different attachments which are relatively easily interchanged at the construction site. A further advantage is provided by this arrangement in that attachments which become damaged in the course of ordinary use or in transit between jobs are readily replaced without loss of utility of the excavating equipment.

Rippers having varying numbers of teeth and associated with buckets of differing capacities are often desirable in excavating applications. These instruments are typically welded to the buckets and fulfill at least two useful purposes: they facilitate breaking up of materials generally resistant to removal and they also increase the efficiency of the excavation equipment by enabling increased bucket loads. These are significant advantages for contractors because heavy excavation equipment and operators therefor represent significant capital outlay and it is desirable to optimize the amount of work accomplished per unit time (i.e., excavation/hour) in order to be able to provide competitively priced services and in turn to be able to realize attractive return on investment.

A problem which has been encountered with such approaches is the difficulty in removing ripper attachments from buckets when the ripper attachments are welded thereto. It is particularly inconvenient to perform such removal and/or replacement "in the field" or in situations where time is at a premium (e.g., in disaster cleanup applications, when weather conditions affecting ability to perform the work are known to be changeable, etc.). Removal and/or replacement may be necessitated by damage to the bucket or ripper or both or in response to the particular application for which the instruments are being employed.

Further, the number of attachments which are needed varies with the flexibility with which the attachments are reconfigurable for distinct applications. The capital outlay or fixed costs required in order to efficiently provide a full range of capabilities and the variable expenses associated with deploying the equipment (e.g., transportation, efficiency in use, downtime, etc.) are related to the utility realizable from each piece or attachment as well as the time required to effect a change therein.

Accordingly, it is desirable to realize as many functions as possible with as few pieces as practical and to provide these plural functions with greatest ease and flexibility.

A second, strongly desirable capability not commonly found on either backhoe buckets or on the front buckets of many types of excavating equipment is a capacity for making a cutting stroke or for grading or smoothing already-excavated areas on the backstroke, or draw of the shovel towards the body of the earth-moving apparatus.

In order to combat these varied problems, some form of device for enabling a cutting stroke or for smoothing or grading on the draw stroke is desirable. It is extremely desirable to be able to rapidly configure backhoe buckets in the field for as wide a variety of functions as possible.

The prior art has also provided variations of the above described apparatus for excavating, but none provide the desired range of capabilities concomitant with the desired low inventory of parts and the required library of functional capabilities.

While the various mentioned prior art devices function as apparatus for excavating and ripping, certain inherent deficiencies preclude adequate, satisfactory performance for the purpose of optimizing efficiency and utility of excavating equipment.

It would be highly advantageous, therefore, to remedy the foregoing and other deficiencies inherent in the prior art.

Accordingly, it is an object of the present invention to provide improvements in bucket-borne rippers for excavating equipment.

Another object of the present invention is the provision of an improved, field-detachable ripper attachment for earth-moving equipment buckets.

And another object of the present invention is to provide an improved, field-attachable ripper attachment for earth-moving equipment buckets.

Still another object of the present invention is the provision of a method for attaching and detaching rippers to and from excavating equipment.

Yet another object of the instant invention is to provide a ripper attachment configured for use with any of several buckets.

Yet still another object of the instant invention is the provision of a device for providing a scraping or grading function on the backstroke of a tractor bucket.

And a further object of the invention is to provide a method for coordinating breakup of material with excavation of the broken material in a field configurable instrument.

Still a further object of the immediate invention is the provision of a blade for the rear surface of a front bucket for excavating equipment.

And still a further object of the invention is the provision of method and apparatus, according to the foregoing, which is intended to facilitate ripper coordination with excavation apparatus.

SUMMARY OF THE INVENTION

Briefly, to achieve the desired objects of the instant invention in accordance with a preferred embodiment thereof, provided is a field-detachable and field-attachable ripper having a shank portion including a lower tip, a mounting portion disposed along an upper area of the shank portion and a detachable and re-attachable coupling element disposed along the mounting portion. The ripper desirably but not essentially includes a detachable ripper tip coupled to the lower tip. The detachable ripper tip comprises a metal piece having a point disposed at a first end thereof and has a hollow disposed at a second end thereof. The hollow is adapted to accommodate the lower tip therein. The detachable ripper tip further includes an opening disposed on one side thereof and extending into the hollow. The opening is adapted to accommodate a fastener extending from the side and into the lower tip. The fastener thereby detachably fastens the detachable ripper tip to the lower tip.

Also provided is a blade apparatus for earth-moving equipment including a bucket. The blade apparatus comprises a blade attachment having an upper and a lower edge. The upper edge is coupled to a rear surface of the bucket. The lower edge includes a blade disposed parallel with a lower rear edge of the bucket and behind the bucket. The blade is oriented away from the bucket such that the blade may engage a working surface when the bucket is drawn towards the earth-moving equipment. The blade apparatus includes a plurality of mounting straps disposed along a lower edge thereof. The mounting straps extend from a side of the blade attachment proximal to the lower edge of said blade attachment to the lower rear edge of said bucket.

BRIEF DESCRIPTION OF THE DRAWINGS

The foregoing and further and more specific objects, features and advantages of the instant invention will become readily apparent to those skilled in the art from the following detailed description of preferred embodiments thereof taken in conjunction with the drawings in which:

FIG. 1 is a sketch of an isometric view of a first preferred embodiment of a backhoe bucket and ripper attachment, in accordance with the teachings of the instant invention;

FIG. 2 is sketch of a side view of the first preferred embodiment of the backhoe bucket and ripper attachment of FIG. 1;

FIG. 3 is a sketch of an isometric view of the first preferred embodiment of the ripper attachment of FIGS. 1 and 2;

FIG. 4 depicts a rear view of the first preferred embodiment of the ripper attachment and a portion of the bucket of FIGS. 1 through 3;

FIG. 9 is a sketch of an isometric view of a second preferred embodiment of a backhoe bucket and ripper attachment, in accordance with the teachings of the instant invention;

FIG. 10 is sketch of a side view of the second preferred embodiment of the backhoe bucket and ripper attachment of FIG. 9, showing a detachable and field-replaceable ripper point;

FIG. 11 is a sketch of an isometric view of the second preferred embodiment of the ripper attachment of FIGS. 9 and 10; and FIG. 12 depicts a rear view of the second preferred embodiment of the ripper attachment and a portion of the bucket of FIGS. 9 through 11.

DETAILED DESCRIPTION OF THE PREFERRED EMBODIMENT

Figure 5:
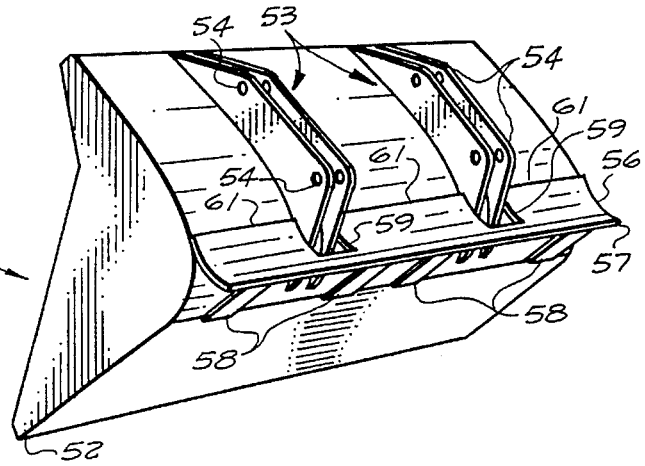
FIG. 5 shows a sketch of a preferred embodiment of a blade attachment for a tractor, backhoe or steam shovel, in accordance with the teachings of the present invention.

Turning now to the drawings, in which like reference characters indicate corresponding elements throughout the several views, attention is first directed to FIG. 1 which illustrates an isometric view of a first preferred embodiment of backhoe bucket 21 having blade 22 together with ripper attachment 34 in accordance with the teachings of the instant invention and generally designated by the reference character 20. In accordance with the configuration chosen for purposes of illustration, bucket/ripper combination 20 includes portions 29 and 32 of a boom used for raising, lowering and otherwise manipulating and articulating functions of bucket/ripper combination 20 under the control of a human operator (not illustrated).

Portions 29 are secured to upper mounting holes 24 in gusset 23 by pins 28 while portions 32 are secured to middle mounting holes 26 via pins 31. Ripper attachment 34 is also secured via pins 31 in middle mounting holes 26 and pins 33 in lower mounting holes 27. Pins 28, 31 and 33 are desirably readily field-installable and detachable, allowing bucket 21 and/or ripper attachment 34 to be readily and easily attached or detached, providing flexibility and adaptability for ripper/bucket combination 20.

Ripper attachment 34 comprises mounting bracket 36, shank 37 and ripping tip 38 disposed at one end of a major axis of shank 37. Ripper attachment 34 allows ripper/bucket combination 20 to be usefully employed for breaking up tough materials encountered in excavation (e.g., caliche, concrete, etc.) as shown in FIG. 1 by concentrating the force provided by boom portions 29 and 32 at ripper tip 38, rather than distributing this force along the width of blade 22. The broken material is then readily loaded by bucket 21 for removal.

It will be appreciated that other arrangements for securing ripper attachment 34 to bucket 21 may be employed and that any conventional field-mountable bucket may be equipped with detachable ripper-type tools in accordance with the present invention. A single ripper attachment can thus serve (or not serve) with any of a variety of different sizes of buckets or related attachments, providing an ensemble of varying capabilities whilst adding relatively little to capital expenditures.

Directing attention now to FIG. 2, a sketch of a side view of the first preferred embodiment of backhoe bucket 21 and ripper attachment 34 of FIG. 1 is provided. FIG. 2 illustrates mounting of ripper attachment 34 in more detail, showing upper mounting lug 41 of ripper attachment 34 secured via pin 31 to middle mounting hole 26 (FIG. 1) and lower mounting lug 42 of ripper attachment 34 secured to lower mounting hole 27 (FIG. 1) in gusset 23 via pin 33. Lower mounting lug 42 is disposed at a second end of the major axis of shank 37 and has a cylindrical axis orthogonal to the major axis. Ripper tip 38 is seen to project below bucket 21, allowing independent use of either bucket 21 or ripper attachment 34 at the discretion of the operator (not illustrated) via suitable articulation of the boom.

FIG. 3 is a sketch of an isometric view of the first preferred embodiment of ripper attachment 34 of the apparatus of FIGS. 1 and 2. Mounting bracket 36 is attached to shank 37 by weld 39, for example. Alternatively, shank 37, mounting bracket 36, ripper tip 38 and mounting lugs 41 and 42 may be formed in one piece by casting. In another embodiment, ripper tip 38 may be detachable, allowing replacement of ripper tip 38 in the event of damage or to provide distinct ripper tips 38 for varying conditions, as discussed in further detail with reference to FIGS. 9 through 12, infra.

FIG. 4 depicts a rear view of the first preferred embodiment of ripper attachment 34 and bucket portion 44 of FIGS. 1 through 3, illustrating how mounting lugs 41 and 42 nest between gussets 23 and boom portions 32 when ripper attachment 34 is coupled to bucket 21 via pins 31 and 33 extending through upper mounting lug 41 and lower mounting lug 42, respectively. Pins 31 and 33 are easily accessible for ready removal and installation.

FIGS. 1 through 4 and associated text thus describe a field-mountable and demountable ripper tool adapted to function with a variety of buckets in earth-moving equipment.

Referring now to FIGS. 5 through 9, a preferred embodiment of blade attachment 56 is illustrated.

FIG. 5 shows a sketch of a preferred embodiment of blade attachment 56 for a tractor, backhoe or steam shovel (not illustrated), in accordance with the teachings of the present invention. Blade attachment 56 having blade 57 disposed thereon is coupled to a lower rear surface of bucket 51 via weld 61 and straps 58 and is adapted for cutting, grading or scraping material in a smooth fashion during a backstroke of bucket 51 and may also be usefully employed for smoothing a disturbed area following excavation of overlying material.

Bucket 51 has gussets 53 including mounting holes 54 for coupling of bucket 51 to locomotive apparatus (e.g., a backhoe, not illustrated) in the conventional fashion. Because gussets 53 typically extend to the lower rear surfaces of bucket 51, openings 59 in blade attachment 56 are desirable. Blade attachment 56 is disposed such that blade attachment 56 does not compromise or hinder normal use and/or motion of bucket 51. Blade attachment 56 is thus securely attached to and supported by bucket 51.

Figure 6:
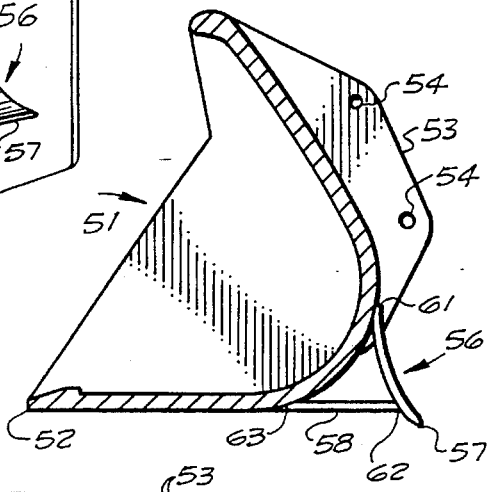
FIG. 6 illustrates a side view of the bucket and the preferred embodiment of the blade attachment of FIG. 5.

Attention is now drawn to FIG. 6, illustrating a side view of bucket 51 and the preferred embodiment of blade attachment 56 of FIG. 5. Blade attachment 56 is secured to bucket 51 at an upper edge of blade attachment 56 by welds 61 and is secured to first ends of straps 58 by welds 62 disposed proximal to blade edge 57 and on a surface of blade attachment 56 generally opposed to blade edge 57. Second ends of straps 58 are secured to the lower rear surface of bucket 51 via welds 63. Blade attachment 56 may be planar or may be curved. In the latter case, blade attachment 56 is desirably mounted with a convex surface towards bucket 51, as shown in FIG. 6.

Figure 7:
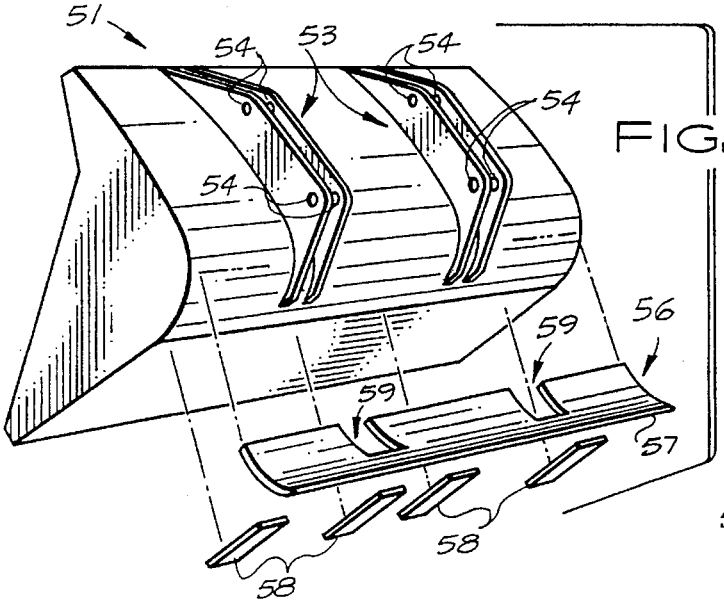
FIG. 7 depicts an exploded view of the bucket and the preferred embodiment of the blade attachment of FIGS. and 6, illustrating the relationship between the components thereof.

FIG. 7 depicts an exploded view of bucket 51 and the preferred embodiment of blade attachment 56 of FIGS. 5 and 6, illustrating the relationship between the components thereof. Straps 58 are disposed evenly along the length of blade attachment 56 to provide support for blade attachment 56 during cutting and/or scraping operations. Blade attachment 56 may extend substantially along the full width of bucket 51 (as illustrated) or may be of a lesser width.

It will be appreciated by those of skill in the relevant arts that blade attachment 56 may be bolted to a second plate (not illustrated) along the upper edge of blade attachment 56 while the second plate is in turn welded to bucket 51 in a fashion similar to that illustrated by welds 61 of FIGS. 5 and 6. Similarly, straps 58 may bolt to suitable threaded apertures disposed in a fashion analogous to that of welds 63 disposed along the lower rear edge of bucket 51. This and similar arrangements allow for ready removal or installation of blade attachment 56 requiring only the aid of hand tools and hand labor, providing reconfigurability without compromise of utility in the field.

Figure 8:
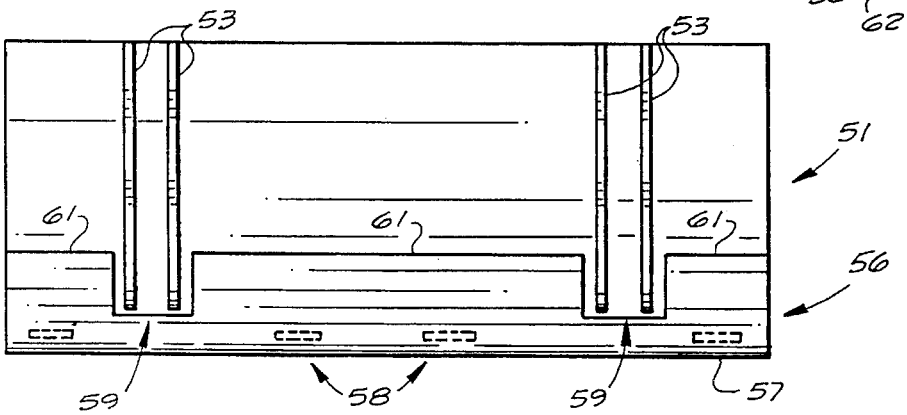
FIG. 8 depicts a rear view of the bucket and the preferred embodiment of the blade attachment of FIGS. 5 through 7.

FIG. 8 depicts a rear view of bucket 51 and the preferred embodiment of blade attachment 56 of FIGS. 5 through 7, showing how gussets 53 and openings 59 mate when blade attachment 56 is installed on bucket 51 and further illustrating placement of straps 58, shown in dotted outline.

FIGS. 5 through 8 and associated text thus describe a blade attachment for use in cutting, grading or smoothing during the backstroke of earth-moving equipment buckets.

Directing attention now to FIGS. 9 through 12, a second preferred embodiment of backhoe bucket 71 and ripper attachment 75 is illustrated, in accordance with the teachings of the instant invention.

FIG. 9 is a sketch of an isometric view of a second preferred embodiment of backhoe bucket 71 having blade 72 and ripper attachment 75 having detachable ripper tip 91. It will be appreciated that bucket 71 is attached to two upper boom members 79 but only a single lower boom member 82, in contrast to bucket 21 (FIGS. 1 and 2). Upper boom members 79 are coupled to upper mounting holes 74 via pins 78 while lower boom member 82 is coupled to middle mounting holes 81 via pin 83. Accordingly, the strategy for removably coupling ripper attachment 75 to bucket 71 must differ from the strategy employed in removably coupling ripper attachment 34 to bucket 21 in some details.

Ripper attachment 75 is shown to comprise body 89, distal end 93 having detachable ripper tip 91 disposed thereon, coupling extensions 87 coupled to a proximal end of body 89 and coupling arms 88 disposed at either outward end of coupling extensions 87. Coupling arms 88 are secured via removable pins 84 through holes 76 in gusset 73 to bucket 71 and couple to body 89 of ripper attachment 75 via coupling extensions 87. A second attachment of ripper attachment 75 to bucket 71 is effected via pins 86 extending through lower holes 77 in gusset 73 and is shown in more detail in FIGS. 10 through 12, infra.

Attention is now drawn to FIG. 10, which is sketch of a side view of the second preferred embodiment of backhoe bucket 71 and ripper attachment 75 of FIG. 9, showing detachable and field-replaceable ripper point 91 coupled to distal end 93 of body 89 via securing device 92. Detachable ripper point 91 has a hollow disposed on one end thereof adapted to mate with distal end 93 of body 89. Securing device 92 comprises a pin or bolt or other field-serviceable fastening arrangement.

FIG. 11 is a sketch of an isometric view of the second preferred embodiment of ripper attachment 75 of the apparatus of FIGS. 9 and 10, showing mounting lug 96 in more detail. Turning now to FIGS. 10 and 11, mounting lug 96 is adapted to receive pin 86 extending through lower mounting hole 77 in gusset 73 of bucket 71, thereby coupling ripper attachment 75 to bucket 71. Coupling arms 88 have mounting holes 94 adapted to receive pin 84 extending through middle mounting hole 76 in gusset 73 of bucket 71, thereby coupling ripper attachment 75 to bucket 71. Ripper attachment 75 may be fashioned by one-piece casting, for example, or may be assembled from suitably shaped stock by welding.

FIG. 12 depicts a rear view of the second preferred embodiment of ripper attachment 75 and bucket portion 98 of FIGS. 9 through 11. Distal end 93 and detachable ripper tip 91 extend well below a lower edge of bucket portion 98 and ripper attachment 75 does not interfere with articulation of upper 79 and lower 82 boom members or of bucket 71.

FIGS. 9 through 12 and associated text thus describe a field-mountable and demountable ripper attachment having a detachable and field-replaceable ripper tip and adapted to function with a variety of buckets in earth-moving equipment. Field removal and/or replacement of ripper attachment 75 and/or bucket 71 is easily effected via pins 78, 83, 84 and/or 86.

It will be appreciated that other physical arrangements of these components are possible without compromise of the functionality thereof and that the specific embodiment may include, for example, more or fewer pins for securing components and that the bucket/ripper combination may accommodate other and/or additional functions as well.

Rippers such as those illustrated in FIGS. 1 through 4 and 9 through 12 and blade attachments such as that illustrated in FIGS. 5 through 8 are typically fashioned from high quality alloy steel and are desirably fashioned by casting. Rippers usefully extend a first distance beyond the bucket, wherein the first distance is desirably in a range of from four to six inches. Blades such as that associated with the blade attachment shown and described herein desirably are aligned with the bucket such that the bottom of the blade is in line with the bottom of the bucket when the bucket is operated such that the bottom of the bucket is parallel with the ground.

The foregoing detailed description of the several embodiments of the instant invention for the purposes of explanation have been particularly directed toward the application in association with backhoe buckets and the like. It will be appreciated that the invention is equally useful for other earth-moving and excavating equipment wherein detachable elements are desirably employed in realizing a complement of useful functions.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

I claim:

1. In an excavating apparatus including a bucket removably coupled to a distal end of a hydraulically powered boom, a field-detachable and field-attachable ripper comprising:

a shank having a lower tip;

a mounting portion disposed along an upper area of said shank; and a first attachment means disposed along said mounting portion adapted to detachably and re-attachably couple said field-detachable and field-attachable ripper to said bucket via at least one field-removable and field-installable pin, and a second attachment means disposed along said mounting portion adapted to detachably and re-attachably couple said field-detachable and field-attachable ripper to said bucket via at least one field-removable and field-installable pin, said first and second attachment means together coupling said ripper to said bucket so that said ripper is fixed relative said bucket.

2. The field-detachable and field-attachable ripper as claimed in claim 1, wherein one of said pins also couples said bucket directly to said boom.

3. The field-detachable and field-attachable ripper as claimed in claim 1, wherein there is further included a detachable ripper tip coupled to said lower tip, said detachable ripper tip comprising a metal piece having a point disposed at a first end thereof and having a hollow disposed at a second end thereof, said hollow adapted to accommodate said lower tip therein, said detachable ripper tip further including an opening disposed on one side thereof and extending into said hollow, said opening adapted to accommodate a fastener extending from said side and into said lower tip, said fastener thereby detachably fastening said detachable ripper tip to said lower tip.

4. The field-detachable and field-attachable ripper as claimed in claim 1, wherein said field-detachable and field-attachable ripper is adapted to extend further from said boom in at least a first direction than said bucket extends from said boom in said first direction.

5. The field-detachable and field-attachable ripper as claimed in claim 1, wherein said first attachment means comprises a first mounting lug having a first cylindrical aperture adapted to accommodate a first pin removably coupling said field-detachable and field-attachable ripper and said bucket to said boom, said first mounting lug disposed on a mounting bracket coupled to said shank, said first mounting lug having a cylindrical axis orthogonal to a major axis of said shank; and said second attachment means including a second mounting lug having a second cylindrical aperture adapted to accommodate a second pin removably coupling said field-detachable and field-attachable ripper to said bucket of said excavating apparatus, said second mounting lug disposed along and orthogonal to said major axis of said shank, below said first mounting lug.

6. The field-detachable and field-attachable ripper as claimed in claim 5, wherein said first mounting lug nests between gussets coupled to said bucket, wherein said gussets include holes adapted to couple said bucket to said boom via pins including said first pin.

7. The field-detachable and field-attachable ripper as claimed in claim 1, wherein said first attachment means includes a first mounting lug having a first cylindrical aperture adapted to accommodate a first pin removably coupling said field-detachable and field-attachable ripper to said bucket, said first mounting lug disposed on a mounting bracket coupled to said shank, said first mounting lug having a cylindrical axis orthogonal to a major axis of said shank;

said second attachment means includes a pair of coupling extensions extending from said mounting bracket and a pair of coupling arms, each of said pair of coupling arms having a first end coupled to an end of a coupling extension remote from said mounting bracket and extending from said remote end to a second end of said coupling arm adapted to couple to a pin securing said bucket to said boom.

8. The field-detachable and field-attachable ripper as claimed in claim 1, wherein said field-detachable and field-attachable ripper is adapted to function with any of several buckets of differing sizes.

9. In an excavating apparatus, said apparatus including:

a bucket removably coupled to a distal end of a hydraulically powered boom; and a field-detachable and field-attachable ripper attachment coupled to said bucket such that said ripper is fixed relative said bucket comprising:

a shank having a lower tip;

a mounting portion disposed along an upper area of said shank; and a first attachment means disposed along said mounting portion adapted to couple said field-detachable and field-attachable ripper to said bucket via at least one field-removable and field-installable pin, and a second attachment means disposed along said mounting portion adapted to fix said field-detachable and field-attachable ripper relative to said bucket via at least one field-removable and field-installable pin.

10. The apparatus as claimed in claim 9, wherein said field-detachable and field-attachable ripper attachment further comprises a detachable ripper tip coupled to said lower tip, said detachable ripper tip comprising a metal piece having a point disposed at a first end thereof and having a hollow disposed at a second end thereof, said hollow adapted to accommodate said lower tip therein, said detachable ripper tip further including an opening disposed on one side thereof and extending into said hollow, said opening adapted to accommodate a fastener extending from said side and into said lower tip, said fastener thereby detachably fastening said detachable ripper tip to said lower tip.

11. The apparatus as claimed in claim 9, wherein said first attachment means includes a first mounting lug having a first cylindrical aperture adapted to accommodate a first pin removably coupling said field-detachable and field-attachable ripper to said bucket, said first mounting lug disposed on a mounting bracket coupled to said shank, said first mounting lug having a cylindrical axis orthogonal to a major axis of said shank; and said second attachment means includes a pair of coupling extensions extending out from said mounting bracket and a pair of coupling arms, each of said pair of coupling arms having a first end coupled to an end of a coupling extension remote from said mounting bracket and extending from said remote end to a second end of said coupling arm adapted to couple to a pin securing said bucket to said boom.

12. The apparatus as claimed in claim 9, wherein said first attachment means includes a first mounting lug having a first cylindrical aperture adapted to accommodate a first pin removably coupling said field-detachable and field-attachable ripper and said bucket to said boom, said first mounting lug disposed on a mounting bracket coupled to said shank, said first mounting lug having a cylindrical axis orthogonal to a major axis of said shank; and said second attachment means includes a second mounting lug having a second cylindrical aperture adapted to accommodate a second pin removably coupling said field-detachable and field-attachable ripper to said bucket of said excavating apparatus, said second mounting lug disposed along and orthogonal to said major axis of said shank, below said first mounting lug.

* * * * *